United States Patent [19]

Yamamoto et al.

[11] 4,210,076

[45] Jul. 1, 1980

[54] PRINTING APPARATUS

[75] Inventors: Takahiro Yamamoto; Kazuo Sugano, both of Katsuta, Japan

[73] Assignee: Hitachi Koki Company, Limited, Tokyo, Japan

[21] Appl. No.: 909,106

[22] Filed: May 24, 1978

[30] Foreign Application Priority Data

May 25, 1977 [JP] Japan ..... 52/61667

[51] Int. Cl.[2] ..... B41J 1/20

[52] U.S. Cl. ..... 101/111; 101/93.14; 400/59

[58] Field of Search ..... 101/93.14, 111, 93.03; 400/55, 56, 58, 59

[56] References Cited

U.S. PATENT DOCUMENTS

| | | | |
|---|---|---|---|
| 3,155,032 | 11/1964 | Antonucci | 400/58 |
| 3,499,382 | 3/1970 | Potter | 101/93.14 |
| 3,747,521 | 7/1973 | Hamilton | 101/93.14 |
| 3,960,074 | 6/1976 | Chau | 101/111 |
| 3,981,235 | 9/1976 | Thomas | 101/93.14 |

OTHER PUBLICATIONS

IBM Tech. Disc. Bul., vol. 20, No. 11A, Apr. 1978, p. 4270, Blaskovic et al.

IBM Tech. Disc. Bul., vol. 14, No. 7, Dec. 1971, p. 2193, Hunt.

*Primary Examiner*—Clyde I. Coughenour

*Attorney, Agent, or Firm*—Lowe, King, Price & Becker

[57] ABSTRACT

A printing apparatus comprising a stationary frame structure having accommodated therewithin a plurality of printing hammers arranged in a row, a tiltable support structure positioned in front of the frame structure and rotatable about an axis fixed on the frame structure, a type carrier movable on the support structure partially along a straight travelling path extending in parallel with the row of the printing hammers and forming an elongated clearance between the travelling path and the row of the printing hammers, position retaining means for holding the support structure in an inoperative position having the travelling path of the type carrier spaced wider apart from the row of the printing hammers, clearance adjusting means for minutely adjusting the above mentioned clearance depending upon the thickness of the printing sheet or sheets to be printed at a time, and cam means providing a mechanical and functional intervention between the position retaining and clearance adjusting means.

12 Claims, 9 Drawing Figures

PRINTING APPARATUS

BACKGROUND OF THE INVENTION

1. Field of the Invention

The present invention relates to printing apparatus such as back printers or line printers and more particularly to a printing apparatus of the type which uses a type carrier which is constituted by an endless belt, chain or other continuously movable train carrying thereon various letters, numerals and/or symbols to be used for the graphic recording of information.

2. Description of the Prior Art

A printing apparatus known as a line or back printer usually comprises a stationary rear frame structure having a number of printing hammers arranged in a row in a lateral direction of the frame structure and a tiltable support structure positioned in front of the frame structure and having a type carrier supported on top of the support structure. During printing of the printing apparatus of this type, the type carrier is driven to travel in front of the row of the printing hammers with an inking ribbon located between the type carrier and the row of the printing hammers and a printing sheet or a set of printing sheets located between the inking ribbon and the row of the printing hammers. The individual printing hammers are selectively driven to move or turn forwardly against the reverse side of the printing sheet or of the rearmost one of the printing sheets so that the printing sheet or sheets and the inking ribbon are pressed upon between the type carrier and each of the printing hammers driven.

In order that the printing sheet or sheets thus typed be imprinted clearly, it is important that the gap or clearance formed between the type carrier and the row of the printing hammers across the printing sheet or sheets and the inking ribbon be minutely adjusted to suit the thickness of the printing sheet or the set of printing sheets set on the apparatus, the printing sheets being usually superposed on one another with a duplicating carbon paper interleaved between every adjacent two of the printing sheets. Thus, a known printing apparatus of the type described has incorporated therein clearance adjusting means which is adapted to enable the tiltable support structure of the printing apparatus to slightly move toward or away from the rear frame structure so that the above mentioned clearance between the type carrier on the front support structure and the row of the printing hammers within the rear frame structure can be minutely varied depending upon the thickness of the printing sheet or the set of printing sheets and carbon papers to be put to use concurrently on the apparatus.

The printing sheet or the set of printing sheets and duplicating carbon papers is vertically passed through the above mentioned clearance and further between the front end of the rear frame structure and the rear end of the front support structure and is usually stepwise fed upwardly during operation of the printing apparatus. In order to facilitate mounting of the printing sheet or sheets on the printing apparatus, therefore, it is desired that the clearance or any gap between the front and frame structures be enlarged temporarily. The above mentioned known printing apparatus is therefore further provided with means adapted to move or turn the front support structure into an inoperative position forwardly spaced apart from the rear frame structure and to hold the support structure in the inoperative position for maintaining a sufficiently broad gap or clearance therebetween throughout the operation for mounting a printing sheet or sheets on the apparatus.

In a conventional printing apparatus of this nature, however, the position retaining means and the clearance adjusting means are constructed and operate independently of each other. In the absence of mechanical and functional intervention between the position retaining and clearance adjusting means, a printing apparatus arranged with such means tends to be complex in construction and require cumbersome manipulative steps for operating the apparatus with use of any of these means.

SUMMARY OF THE INVENTION

It is, accordingly, an object of the present invention to provide an improved printing apparatus of the line or back printer type incorporating position retaining and clearance adjusting means which are effectively and ingeniously combined together in construction and function so that the printing apparatus can be constructed compactly and can be operated with ease.

In accordance with the present invention, such an object will be accomplished in a printing apparatus having lateral and fore-and-aft dimensions and including a stationary structure, a plurality of printing hammers arranged in a row within the stationary structure in a direction substantially parallel with the lateral dimension of the apparatus, a tiltable structure which is positioned in front of the stationary structure and which is rotatable about an axis of rotation substantially parallel with the lateral dimension of the apparatus and fixed with respect to the stationary structure, and a type carrier movable on the support structure and having a substantially straight travelling path located in front of the row of the printing hammers and substantially parallel with the lateral dimension of the apparatus, wherein the improvement comprises position retaining means engaging both of the stationary and tiltable structures and operable for retaining the tiltable structure in an operative position having the above mentioned travelling path of the type carrier located adjacent to the row of the printing hammers for forming an elongated clearance between and parallel with the row of the printing hammers and the travelling path of the type carrier and an inoperative position downwardly inclined about the above mentioned axis of rotation away from the stationary structure, cam means engaging the tiltable structure and the position retaining means and rotatable relative to the tiltable structure about a fixed axis of rotation substantially parallel with the above mentioned axis of rotation of the tiltable structure, the position retaining means having rotational motion about an axis substantially parallel with and movable with respect to the above mentioned fixed axis of rotation of the cam means for effecting movement of the tiltable structure between the aforesaid operative and inoperative positions thereof and linear motion in a direction substantially perpendicular to the lateral dimension of the apparatus for moving the tiltable structure angularly about the above mentioned axis of rotation of the tiltable structure in a direction to vary the clearance between the aforesaid travelling path of the type carrier and the row of the printing hammers, the engagement between the cam means and the position retaining means being such that the rotation of the cam means about the above mentioned fixed axis of rotation thereof produces the above mentioned linear motion of the position retaining means, and clearance adjusting means which is mounted on the tiltable structure and which is operative to produce the above mentioned rotation of the cam means, the clearance adjusting means being manually operated for driving the cam means to produce the rotation thereof.

BRIEF DESCRIPTION OF THE DRAWINGS

The features and advantages of a printing apparatus according to the present invention will be more clearly appreciated from the foregoing description taken in conjunction with the accompanying drawings in which like reference numerals designate corresponding or similar members, elements and structures throughout the drawings and in which.

DESCRIPTION OF THE PREFERRED EMBODIMENTS

Figure 1:
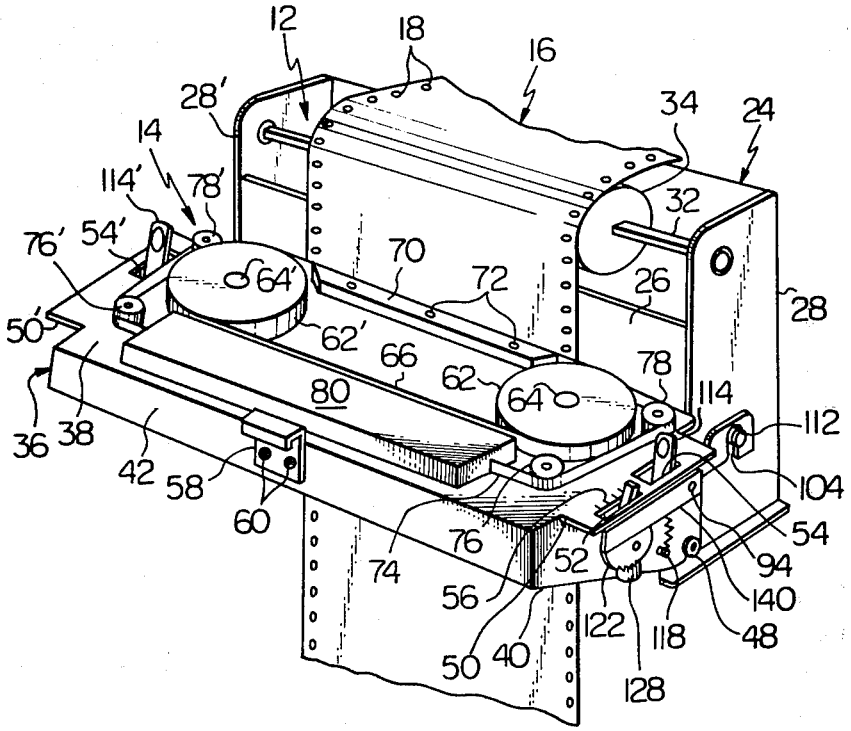
FIG. 1 is a perspective view showing a preferred embodiment of a printing apparatus according to the present invention.
Figure 2:
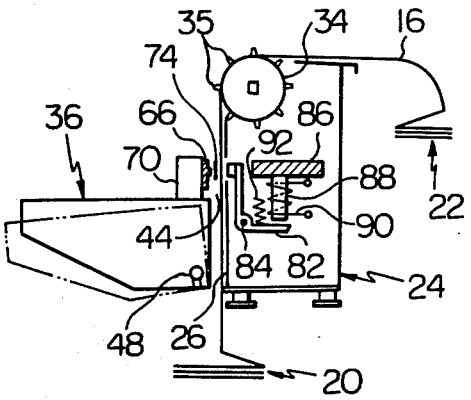
FIG. 2 is a side elevational view schematically showing, partly in cross section, some structures and elements of the printing apparatus illustrated in FIG. 1.
Figure 3:
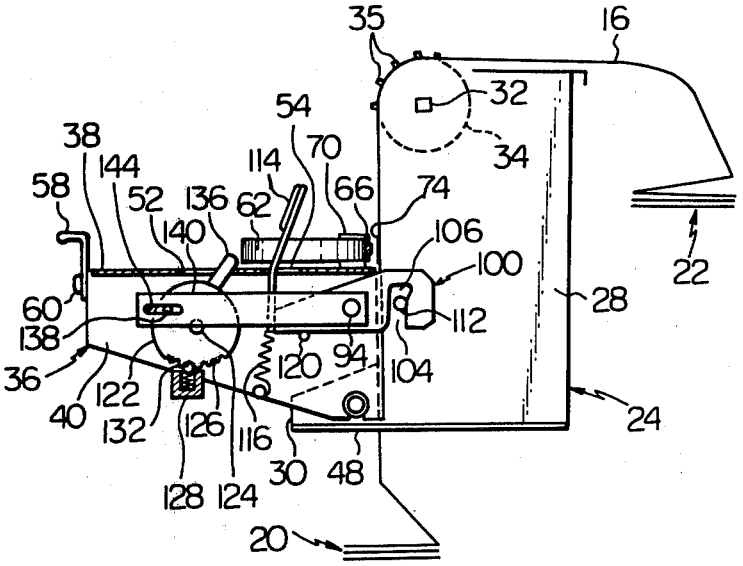
FIG. 3 is a side elevational view chiefly showing the position retaining and clearance adjusting means of the printing apparatus illustrated in FIGS. 1 and 2.

Referring concurrently to FIGS. 1 to 5 of the drawings, a printing apparatus embodying the present invention comprises, as is customary, a paper feed mechanism 12 for intermittently feeding a printing sheet of paper or a set of printing sheets of paper through a horizontal print-line position at which printing of type characters is to take place, and a printing mechanism 14 for producing prints of the type characters on the front face or faces of the printing sheet or sheets being passed through the print-line position. Although only one printing sheet as indicated at 16 in FIGS. 1 to 3 is shown to be in use on the apparatus embodying the present invention, the printing apparatus according to the present invention is capable of producing two or more sheets of printed document including one original and at least one duplicate at a time. Thus, the single printing sheet 16 shown in the drawings is also representative of a set of printing sheets of paper which may be arranged on the apparatus according to the present invention. When a plurality of printing sheets are to be in use concurrently, the printing sheets are superposed on each other with a duplicating carbon paper interleaved between every adjacent two of the sheets to be in use, though not shown in the drawings. As best seen in FIG. 1 of the drawings, the printing sheet 16 for use in the apparatus embodying the present invention has formed in each of its side marginal portions a series of perforations 18 which are arranged at equal intervals along the side margin.

As shematically shown in FIGS. 2 and 3 of the drawings, the printing apparatus has a suitable supply stage 20 disposed below the above mentioned print-line position of the printing sheet 16 to be imprinted and a suitable re-storage or delivery stage 22 located in the rear of the print-line position. The paper feed mechanism 12 is adapted to have the printing sheet 16 stepwise fed from the supply stage 20 to the re-storage or delivery stage 22 through the print-line position during operation of the apparatus as will be set out in more detail as the description proceeds.

Figure 5:
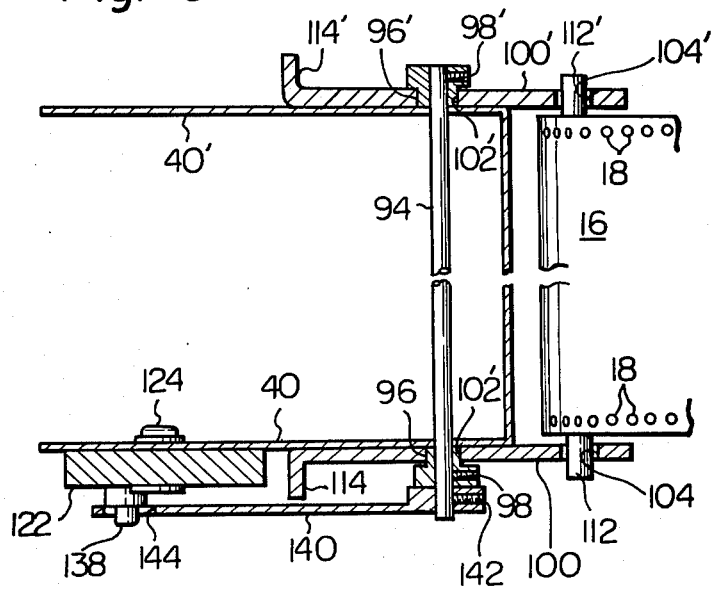
FIG. 5 is a sectional view taken on line V—V of FIG. 4.

Both the paper feed mechanism 12 and the printing mechanism 14 are supported by a frame structure 24 having a laterally or horizontally elongated vertical front plate 26, and a pair of spaced parallel side plates 28 and 28' which are positioned at the opposite lateral ends, respectively, of the front plate 26 as shown in FIG. 1. Each of the side plates 28 and 28' has a front bracket portion 30 projecting forwardly from a lower end portion of the side plate as shown in FIG. 5 and will be more clearly seen from the illustration of FIG. 3 in which only the bracket portion 30 of the right-hand side plate 28 is shown partially by a broken line.

A shaft 32 having a rectangular cross section extends horizontally between the side plates 28 and 28' of the above described frame structure 24 and is rotatably journaled at its opposite axial ends in the side plates. The shaft 32 has mounted thereon a pair of sprocket or tractor wheels 34 (only one of which is shown in the drawings as in FIG. 1), each of which has radial pins or sprocket projections 35 arranged along the entire outer perimeter of the tractor wheel at a pitch corresponding to the intervals between the individual perforations 18 in the printing sheet 16. The tractor wheels 34 are movable on the shaft 32 in the axial direction of the shaft so that, when the tractor wheels are horizontally spaced apart a certain distance from each other on the shaft 32, the pins or sprocket projections 35 of each of the tractor wheels 34 are located in alignment with the series of perforations 18 along each side margin of the printing sheet 16 set in the printing apparatus and are permitted to successively enter the perforations 18 as the shaft 32 and accordingly the tractor wheels 34 are rotated about the center axis of the shaft 32. The shaft 32 is operatively connected to suitable intermittent-motion drive means such as a stepping-motor drive unit (not shown) which is adapted to drive the shaft 32 and accordingly the tractor wheels 34 to rotate about the center axis of the shaft through an angle corresponding to a predetermined spacing between the lines of characters to be typed on the printing sheet 16 each time the drive unit is actuated either manually or in an automatic fashion. Since the paper feed mechanism 12 thus comprising the shaft 32 and the tractor wheels 34 as well as the above mentioned intermittent-motion drive means is well known in the art and is rather immaterial to the understanding of the subject matter of the present invention, description regarding further details of the construction thereof will not be herein incorporated. Futhermore, it may be noted that the construction and arrangement of the paper feed mechanism 12 of the printing apparatus embodying the present invention as above outlined is merely for the purpose of illustration and may therefore be modified in any desired manner or replaced with any other type of drive mechanism adapted to feed a printing sheet or sheets (with or without perforations) through a horizontal print-line position in a stepwise or otherwise controlled fashion. The shaft 32 in the paper feed mechanism 12 having the above described general construction may be replaced with an axially serrated cylindrical rod having the tractor wheels splined thereto.

On the other hand, the printing mechanism 14 of the apparatus embodying the present invention comprises a tiltable carrier support structure 36 which is shown consisting of a substantially flat top plate 38 (FIGS. 1, 3 and 4) having horizontally extending front and rear ends which are substantially parallel with the front plate 26 of the above described frame structure 24, a pair of spaced parallel side plates 40 and 40' (FIG. 5) projecting downwardly from lateral end portions, respectively, of the top plate 38, and a vertical front plate 42 (FIGS. 1, 3 and 4) projecting downwardly from the front end of the top plate 38 and laterally extending between the side plates 40 and 40'. The rear end of the top plate 38 is forwardly spaced apart from the front plate 26 of the frame structure 24 and forms a horizontally elongated gap 44 between the rear end of the top plate 38 and the front plate 26 of the frame structure 24 as shown in FIGS. 2 and 3 of the drawings. The previously mentioned print-line position of the printing sheet 16 is located immediately above the gap 44 thus formed between the front plate 26 of the frame structure 24 and the top plate 38 of the support structure 36. The gap 44 horizontally extends throughout or beyond the distance between the side plates 28 and 28' of the frame structure 24.

Figure 4:
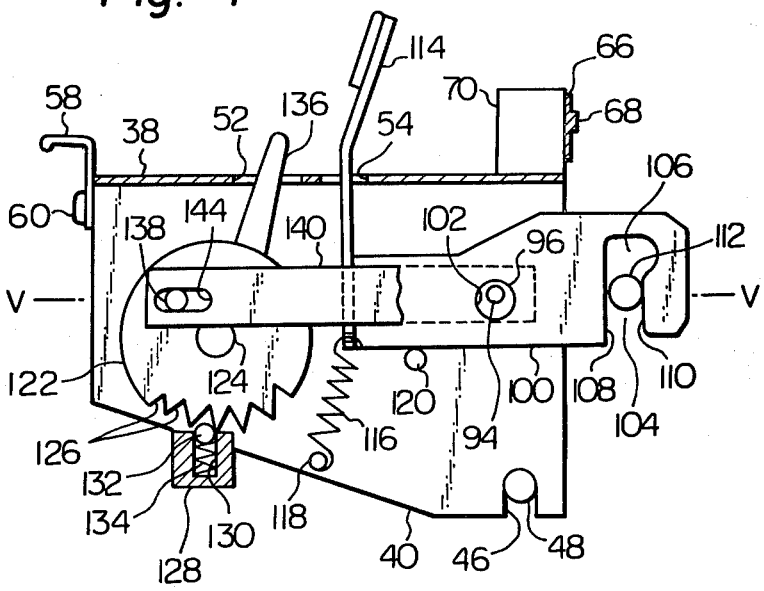
FIG. 4 is a side elevational view showing, to an enlarged scale, the position retaining, clearance adjusting and cam means incorporated in the embodiment illustrated in FIGS. 1 to 3.

Each of the side plates 40 and 40' of the support structure 36 has a rear lower end portion overlapping each of the forwardly projecting lower bracket portions 30 of the side plates 28 and 28' of the frame structure 24, as will be best seen from FIG. 3. The respective rear lower end portions of the side plates 40 and 40' of the support structure 36 are assumed to be located on the outer side of the bracket portions 30 of the side plates 28 and 28', respectively, of the frame structure 24 as will be seen from FIGS. 1 and 3 and may thus be in contact with the outer faces of the bracket portions 30. Each of the side plates 40 and 40' thus arranged has formed in the above mentioned rear lower end portion thereof a vertical slot 46 which is open at the lower end of the particular portion of the side plate and which terminates with a semicircularly curved edge at its upper end, as best seen in FIG. 4. The carrier support structure 36 is pivotally and detachably supported on the side plates 28 and 28' of the frame structure 24 by means of pivotal pins or studs 48 each secured to each of the side plates 28 and 28' of the frame structure 24 and received in the vertical slot 46 in each of the side plates 40 and 40' of the support structue 36, as will be seen from FIGS. 1 to 4 in which only the pivot means constituted by the pin or stud 48 providing pivotal connection between the respective side plates 28 and 40 of the frame and support structures 24 and 36 is shown. The pivotal pins or studs 48 project substantially perpendicularly from the respective outer faces of the above mentioned front bracket portions 30 of the side plates 28 and 28', respectively, of the frame structure 24 and have respective center axes which are substantially in line with each other in parallel with the lateral dimension of the printing apparatus. The side plates 40 and 40' of the support structure 36 are slidably received on these pins or studs 48, respectively, at the semicircularly curved upper ends of the vertical slots 46 in the side plates. Thus, the support structure 36 is not only supported by the frame structure 24 in weight transmitting relationship to the pins or studs 48 on the side plates 28 and 28' of the frame structure but is tiltable in its entirety about a fixed axis which is in part coincident with the respective center axes of the pins or studs 48. If desired, the pins or studs 48 thus provided only at the opposite lateral ends of the frame and support structures 24 and 36 may be replaced with a single shaft extending substantially in parallel with the lateral dimension of the printing apparatus throughout the distance between the side plates 40 and 40' of the support structure 36 and having opposite axial end portions which are arranged similarly to the above described pins or studs 48, respectively.

The top plate 38 of the support structure 36 has lateral projections or ledge portions 50 and 50' projecting laterally outwardly from above the side plates 40 and 40', respectively, of the support structure 36 as shown in FIG. 1. One ledge portion, say, the right-hand ledge portion 50 as shown, is formed with slots 52 and 54 each of which is elongated in a fore-and-aft direction of the printing apparatus as seen in FIGS. 1, 3 and 4. One slot 52 is located forwardly of the outer slot 54 in the ledge portion 50 and is associated with graduations 56 applied to the upper face of the top plate 38 and arranged along one longitudinal or lateral end of the slot 52. As will be described in more detail, the graduations 56 thus provided in association with the front slot 52 in the top plate 38 are representative of various predetermined thicknesses or numbers of printing sheets which can be properly or satisfactorily imprinted at a time with a duplicating carbon paper interposed between every adjacent two of the printing sheets. In the embodiment herein shown, a slot similar to the rear slot 54 in the right-hand ledge portion 50 of the top plate 38 is also formed in the left-hand ledge portion 50' of the top plate 38 as partially seen at 54' in FIG. 1. The slots 54 and 54' thus provided in the ledge portions 50 and 50', respectively, of the top plate 38 are substantially aligned with each other in a lateral direction of the printing apparatus. To the outer face of the vertical front plate 42 of the support structure 36 is fixedly attached a lifting handle 58 (FIG. 1) for manually raising the support structure 36 angularly about the axis of rotation which is constituted by the respective center axes of the pivotal pins or studs 48. The lifting handle 58 is located preferably at substantially equal distances from the opposite lateral ends of the front plate 42 and is fixed to the outer face of the front plate 42 by suitable fastening means such as screws 60.

Over the top plate 38 of the support structure 36 thus constructed and arranged are positioned a pair of pulleys 62 and 62' which are spaced apart a predetermined distance from each other in a lateral direction of the printing apparatus and which are supported by vertical shafts 64 and 64', respectively, each having a center axis substantially normal to the upper face of the top plate 38. One of the pulleys 62 and 62', say, the right-hand pulley 62 for example, is a driving pulley which is rotatable with the associated shaft 64 and which is operatively connected through the shaft 64 to suitable drive means (not shown) provided underneath the top plate 38. The other pulley, viz., the left-hand pulley 62' is a driven pulley which is rotatable on the associated shaft 64'. Between the driving and driven pulleys 62 and 62' thus arranged over the top plate 38 of the support structure 36 is passed a flexible endless band 66 of, for example, stainless steel. The endless band 66 constitutes a type carrier having formed on or fixedly attached to its elongated, continuous outer face a series of type characters 68 (FIGS. 3 and 4) which are arranged at regular intervals throughout the continuous length of the band 66. The type characters herein referred to may include alphabetic letters, numerals and other signs, marks and symbols useful for the graphic recording of information and each of the type characters thus formed or mounted on the endless belt 66 is a mirror image of the actual pattern of the letter, numeral or symbol represented by the character. The shafts 64 and 64' supporting the driving and driven pulleys 64 and 64', respectively, are located on the carrier support structure 36 so that the endless band 66 has a substantially horizontal rear travelling path or portion which is located immediately above the previously mentioned horizontal elongated gap 44 between the vertical front plate 26 of the frame structure 24 and the rear end of the top plate 38 of the support structure 36 and which extends adjacent to and substantially in parallel with the previously mentioned print-line position of the printing sheet 16 set on the paper feed mechanism 12, as will be seen from FIGS. 2 to 4. The driving and driven pulleys 62 and 62' have substantially equal diameters so that the type carrier band 66 further has a substantially horizontal front travelling path extending substantially in parallel with the above mentioned rear travelling path of the band 66 as will be seen from FIG. 1. The shaft 64' supporting the driven pulley 62' in particular may be fixedly secured to the top plate 38 of the carrier support structure 36 so that the distance between the respective center axes of the shafts 64 and 64' for the pulleys 62 and 62' is maintained substantially constant throughout the period of time for which the printing apparatus is to be put to use. Preferably, however, the shaft 64' for the driven pulley 62' is loosely passed through an opening formed in the top plate 38 of the support structure 38 and connected to suitable tension adjusting means provided below the top plate 38, though not shown in the drawings. The tension adjusting means thus connected to the shaft 64' is manually operated to move the driven pulley 62' slightly toward or away from the driving pulley 62 with the shaft 64' for the driven pulley 62' moved through the above mentioned opening in the top plate 38 so that the tension in the type carrier band 66 passed between the pulleys 62 and 62' can be minutely adjusted during assemblage and/or use of the printing apparatus. The pulleys 62 and 62' and the type carrier band 66 passed thereon form part of the previously mentioned printing mechanism 14 of the apparatus embodying the present invention.

The printing mechanism 14 further comprises a horizontally elongated platen 70 having a vertical flat rear face and fixedly positioned on the top plate 38 of the carrier support structure 36 so that the above described endless type carrier band 66 has its inner face in longitudinally slidable contact with the flat rear face of the platen along the above mentioned rear travelling path of the band 66. Thus, the platen 70 is positioned so that the flat rear face thereof longitudinally extends in close proximity to and substantially in parallel with the horizontal print-line position of the printing sheet 16 set on the paper feed mechanism 12, as will be seen from FIGS. 1 to 4. The platen 70 is fixedly mounted on the top plate 38 of the carrier support structure by suitable fastening means as at 72 in FIG. 1. The pulleys 62 and 62' and the platen 70 thus arranged form part of carrier driving and guiding means of the printing mechanism 14 of the apparatus embodying the present invention.

The printing mechanism 14 further comprises an inking ribbon 74 which is arranged on the top plate 38 of the carrier support structure 36 in such a manner that the ribbon has a rear travelling path or portion which extends substantially in parallel with the elongated flat rear face of the above described platen 70 throughout the length of the face and which closely intervenes between the rear travelling portion of the type carrier band 66 and the print-line position of the printing sheet 16 set on the paper feed mechanism 12. Ribbon guide means are thus provided which include a pair of front ribbon guide rollers 76 and 76' located in front of the pulleys 62 and 62', respectively, and on the opposite lateral end portions of the top plate 38 of the support structure 36, and a pair of rear ribbon guide rollers 78 and 78' which are located at the rear of the pulleys 62 and 62', respectively, and on the opposite lateral end portions of the top plate 38, as shown in FIG. 1. Each of the guide rollers 76, 76', and 78 and 78' is rotatably mounted on a shaft secured to the plate 38 of the support structure 36 and having a center axis substantially normal to the upper face of the top plate 38. The inking ribbon 74 passed on the ribbon guide rollers 76, 76', 78 and 78' thus arranged is fed from and returned into an elongated ribbon casing 80 which is positioned in front of the above mentioned front travelling path of the endless type carrier band 66 and which is fixedly but detachably mounted on the upper face of the top plate 38 of the support structure 36 as shown in FIG. 1. The above described front ribbon guide rollers 76 and 76' are located in proximity to the opposite lateral, viz., right-hand and left-hand ends, respectively, of the ribbon casing 80. The inking ribbon 74 to be supplied from the ribbon casing 80 is preferably stored in a folded or otherwise compactly packed condition within the casing 80.

The above described ribbon casing 80 forms part of ribbon supply and drive means of the printing mechanism 14 of the apparatus embodying the present invention. Though not shown in the drawings, the ribbon supply and drive means further comprises a ribbon drive assembly which is operative to pull the inking ribbon 74 toward one lateral end of the ribbon casing 80 past one of the front ribbon guide rollers 76 and 76' so that the ribbon 74 leading to the take-up end of the casing 80 is forced to travel through the individual ribbon guide rollers 76, 76', 78 and 78' toward the take-up end of the casing and accordingly a fresh portion of the inking ribbon which has been stored within the casing is delivered from the opposite lateral end of the casing. Assuming that the inking ribbon 74 is thus delivered from the right-hand end of the ribbon casing 80 shown in FIG. 1, the ribbon 74 is driven to travel through the front and rear ribbon guide rollers 76 and 78 on the right-hand end portion of the top plate 38 of the support structure 36 and then along the previously mentioned rear travelling path of the ribbon 74 toward the rear ribbon guide roller 78' on the left-hand end portion of the top plate 38. The inking ribbon 74 thus moving along the previously mentioned rear travelling path of the ribbon is in sliding contact with the elongated rear travelling portion of the type carrier band 66 and is slightly spaced apart forwardly from the print-line position of the printing sheet 16 set on the paper feed mechanism 12 in the absence of any mechanical pressure urging the printing sheet forwardly at the print-line position thereof. In the embodiment illustrated in FIG. 1, the above mentioned drive assembly for the inking ribbon 74 is assumed to be accommodated within the ribbon casing 80.

The printing mechanism 14 of the apparatus embodying the present invention further comprises a plurality of printing hammers 82 which are housed within the previously described frame structure 24 and which are located at the rear of the vertical front plate 26 of the frame structure, as schematically shown in FIG. 2. The printing hammers 82 are juxtaposed in a row behind the front plate 26 of the frame structure 24 and are rotatably mounted on a common horizontal shaft 84 extending in a lateral direction of the printing apparatus and secured at its opposite axial ends to the side plates 28 and 28' (FIG. 1) of the frame structure 24. Each of the hammers 82 is constructed in the form of a bell-crank lever which has an intermediate fulcrum portion pivotally mounted on the shaft 84 and which further includes a lower control arm portion extending rearwardly from the fulcrum portion and an upper pressing arm portion angularly spaced apart from the lower control arm portion about the center axis of the shaft 84 and extending upwardly from the fulcrum portion. The front plate 26 of the frame structure 24 is formed with a horizontally elongated opening which is substantially coextensive with the printline position of the printing sheet 16 set on the paper feed mechanism 12 as shown in FIG. 2. Each of the printing hammers 82 has its upper end located in the vicinity of the opening thus formed in the front plate 26 of the frame structure 24. Each printing hammer 82 or at least the lower control arm portion thereof is constructed of a ferromagnetic metal.

Within the frame structure 24 is further provided electromagnetically operated hammer drive means comprising a plurality of solenoid units commonly secured to a non-magnetic support member 86 fixedly mounted on the frame structure 24, the individual solenoid units being positioned in association with the individual printing hammers 82, respectively. As schematically illustrated in FIG. 2, each of the above mentioned solenoid units comprises a stationary magnetic core element 88 projecting downwardly from the support member 86 toward a free end portion of the printing hammer 82 associated with the solenoid unit, and a solenoid coil 90 which is helically wound on the magnetic core element 88. Each of the printing hammers 82 is engaged by suitable biasing means such as preloaded helical compression spring 92 urging the printing hammer to turn about the center axis of the shaft 84 in a direction to have the lower control arm portion of the hammer moved away from the leading end of the magnetic core element 88. When the solenoid coil 90 of one solenoid unit is energized, the core element 88 wound with the solenoid coil is magnetically excited and attracts the lower control arm portion of the printing hammer 82 associated with the particular solenoid unit, with the result that the control arm portion of the hammer is moved into abutting engagement with the magnetic core element 88 against the force of the compression spring 92. Thus, each of the printing hammers 82 is rotatable in its entirety about the center axis of the shaft 84 between a rest position having its lower control arm portion spaced apart from the magnetic core element 88 of the associated solenoid unit and its upper pressing arm portion vertically upstanding above the shaft 84 as shown in FIG. 2, and an operative position having the lower control arm portion in contact with the magnetic core element 88 and the upper pressing arm portion forwardly inclined about the center axis of the shaft 84. Each printing hammer 82 is thus urged to assume the rest position thereof by the compression spring 92 and is forced to turn about the center axis of the shaft 84 into the operative position thereof when the coil 90 of the solenoid unit associated with the particular printing hammer is energized. When the printing hammer 82 is held in the rest position having the upper pressing arm portion of the hammer upstanding from the shaft 84 as above described, the upper end of the pressing arm portion is located at the rear of the above mentioned opening in the front plate 26 of the frame structure 24 and is therefore rearwardly spaced apart from the print-line position of the printing sheet 16 set on the paper feed mechanism 12 as shown in FIG. 1. When the coil 90 of one solenoid unit is energized and as a consequence the printing hammer 82 associated with the particular solenoid unit is moved into the above mentioned operative position having its upper pressing arm portion of the hammer forwardly inclined, the upper end of the pressing arm portion moved forwardly out of the frame structure 24 through the opening in the front plate 26 of the frame structure and is brought into abutting and pressing contact with the rear face of the printing sheet 16 at the print-line position of the printing sheet which is set on the paper feed mechanism 12. When one of the printing hammers 82 is thus driven to strike at the upper end of its upper pressing arm portion against the reverse side of the printing sheet 16 set on the paper feed mechanism 12, the printing sheet 16 is pressed at its print-line position against the outer face of the rear travelling portion of the inking ribbon 74, thereby pressing in turn the rear travelling portion of the inking ribbon 74 against any one of the type characters 68 on the endless type carrier band 66 having its rear travelling portion pressed onto the flat rear face of the platen 70. The printing sheet 16 and the inking ribbon 74 are thus pressed between one of the type characters 68 on the type carrier band 66 and the upper end of the pressing arm portion of the printing hammer 82 associated with the solenoid unit having the coil 90 being energized. The printing sheet 16 is in this fashion imprinted with the latter, numeral or symbol represented by the type character 68 which is thus pressed onto the printing sheet 16 at the print-line position of the sheet across the inking ribbon 74. Though not shown in the drawings, the respective coils 90 of the solenoid units are electrically connected to a suitable control circuit which is adapted to be operated by signals to be produced and fed to the printing apparatus from a suitable signal source. The individual solenoid units are selectively actuated and accordingly the individual printing hammers 82 are selectively driven into the operative positions thereof when such signals are successively fed to the control circuit of the printing apparatus.

The construction and arrangement of each of the paper feed and printing mechanisms 12 and 14 which have been hereinbefore described appertain per se to prior art and may therefore be modified in any desired manner. Particularly, the arrangement including the printing hammers 82 and the hammer drive means above described may be not only modified in numerous manners but may be replaced with any of the conventional hammer and hammer-drive arrangements.

When the printing sheet 16 is set on the paper feed mechanism 12 of the printing apparatus constructed and arranged as hereinbefore described, the printing sheet 16 extends in part upwardly from the previously mentioned paper supply stage 20 to the tractor wheels 34 in the frame structure 24 through the horizontal gap 44 between the front plate 26 of the frame structure 24 and the rear end of the top plate 38 of the carrier support structure 36 and in part rearwardly from the tractor wheels 34 to the previously mentioned paper re-storage or delivery stage 22. The printing sheet 16 thus set on the paper feed mechanism 12 intervenes, along the horizontally elongated print-line position thereof, between the rear travelling portion of the inking ribbon 74 and the upper ends of the respective pressing arm portions of the printing hammers 82 arranged in a row in the rear of the print-line position of the printing sheet 16. During operation of the printing apparatus, printing takes place in and along a horizontal gap or clearance between the rear travelling portion of the type carrier band 66 and the upper ends of the printing hammers 82 moved into the respective operative positions thereof. When two or more printing sheets are to be in use concurrently with a duplicating carbon paper interleaved between every adjacent two of the printing sheets, it is therefore desired to have such a clearance enlarged proportionately to the number of the printing sheets to be in use or to the thickness of the set of printing sheets and carbon papers which are alternately superposed on one another. In other words, it is desired that the clearance between the rear travelling portion of the endless type carrier band 66 and the upper ends of the printing hammers 82 moved into the operative positions thereof be varied or adjusted depending upon the number of the printing sheets to be printed at a time or upon the thickness of the set of printing sheets and carbon papers superposed on one another. Adjusting means has therefore been provided to allow the rear travelling portion of the type carrier band 66 to slightly move in a fore-and-aft direction of the printing apparatus so as to make the above mentioned clearance adjustable. When, furthermore, a printing sheet or a set of printing sheets and carbon papers is to be initially mounted on the paper feed mechanism 12, it is desired that not only such a clearance but the previously mentioned gap 44 between the front plate 26 of the frame structure 24 and the rear end of the top plate 38 of the carrier support structure 36 be enlarged to provide ease in upwardly passing the printing sheet or the set of printing sheets and carbon papers through the clearance and gap. Means has therefore been provided to retain the carrier support structure 36 in a forwardly and downwardly tilted position so that the rear end of the top plate 38 of the support structure 36 and accordingly the rear travelling portion of the type carrier band 66 are spaced wider apart from the front plate 26 of the frame structure 24. The conventional clearance adjusting means and position retaining means are constructed and operative independently of each other. The lack of systematic unity between the clearance adjusting and position retaining means of prior art has resulted in disproportionately intricate and unwieldy mechanical constructions requiring various complex and time-consuming techniques in manipulating such means, as noted at the outset of the description. The subject matter of the present invention consists in a useful combination of novel position retaining and clearance adjusting means to be incorporated into a printing apparatus of the type which has been hereinbefore described and shown.

In the embodiment depicted in FIGS. 1 to 5 of the drawings, the position retaining means of the apparatus according to the present invention is shown comprising an elongated shaft 94 extending below the top plate 38 of the carrier support structure 36 and having a horizontal center axis which is substantially parallel with the lateral dimension of the printing apparatus as will be best seen from FIG. 5. The shaft 94 has opposite axial end portions passed through respective rear end portions of the side plates 40 and 40' of the carrier support structure 36 and perpendicularly projecting outwardly from the respective outer faces of the side plates as seen in FIG. 5, the shaft being thus rotatable about its center axis relative to the side plates 40 and 40' and accordingly to the support structure 36. The shaft 94 has fixedly mounted on its opposite axial end portions thus projecting outwardly from the side plates 40 and 40' eccentric cams 96 and 96' each having a circular cam lobe having a center axis offset from the center axis of the shaft 94 as indicated by a broken line in FIG. 4 in which only the cam 96 at the right-hand end of the shaft 94 is shown. As will be seen from FIG. 5, the respective cam lobes of the eccentric cams 96 and 96' thus mounted on the shaft 94 are aligned with each other in a lateral direction of the printing apparatus. In FIG. 5, the cams 96 and 96' are shown to be secured to the shaft 94 by means of clamp screws 98 and 98', respectively, each of which is passed through a radial screw hole formed in a flange portion of each of the cams 96 and 96' for thereby clamping the cam to each of the axial end portions of the shaft 94.

The position retaining means further comprises a pair of lever plates 100 and 100' which are formed with circular slots 102 and 102', respectively, in their respective intermediate portions, as shown in FIG. 5. Each of the slots 102 and 102' thus formed in the lever plates 100 and 100' has a diameter which is effective to have each of the eccentric cams 96 and 96' received therein in such a manner that the circular cam lobe of each cam is in slidable engagement with the entire inner peripheral surface defining the slot, the diameter of each slot being thus substantially equal to or slightly larger than the diameter of the circular cam lobe of each of the cams 96 and 96'. The lever plates 100 and 100' are fitted to the eccentric cams 96 and 96' through the slots 102 and 102', respectively, in the cams and are positioned on the outer faces of the side plates 40 and 40' of the carrier support structure 36 in such a manner as to longitudinally extend substantially in parallel with the fore-and-aft dimension of the printing apparatus. As will be best seen from FIG. 1 in which only the lever plate 100 provided on the right-hand side of the support structure 36 is shown, each of the lever plates 100 and 100' extends rearwardly beyond the rear end of each of the side plates 40 and 40' of the support structure 36 and has a rear end portion located adjacent to the outer face of each of the side plates 28 and 28' of the frame structure 24 positioned at the rear of the support structure 36.

The lever plates 100 and 100' are rotatable relative to their respectively associated side plates 40 and 40' of the carrier support structure 36 about a horizontal axis substantially parallel with the center axis of the cam shaft 94 on which the eccentric cams 96 and 96' engaging the lever plates 100 and 100', respectively, are fixedly mounted. The rotation of the lever plates 100 and 100' relative to the side plates 40 and 40' of the support structure 36 takes place independently of the rotation of the eccentric cams 96 and 96' relative to the side plates 40 and 40' and accordingly of the rotation of the cam shaft 94 which is rotatable about its center axis relative to the side plates 40 and 40' of the support structure 36. As the cam shaft 94 and accordingly the eccentric cams 96 and 96' are rotated as a single unit about the center axis of the shaft 94 relative to the side plates 40 and 40' of the support structure 36, each of the cams 96 and 96' presses upon either of the front and rear end portions of the peripheral cam surface of each of the slots 102 and 102' receiving the cams 96 and 96', respectively, so that each of the lever plates 100 and 100' is urged to move forwardly or rearwardly depending upon the direction in which the cam shaft 94 and accordingly the eccentric cams 96 and 96' are rotated about the center axis of the shaft 94. The axis of rotation of the lever plates 100 and 100' relative to the side plates 40 and 40' of the carrier support structure 36 will thus slightly vary depending upon the angular positions of the eccentric cams 96 and 96' relative to the side plates 40 and 40' and accordingly upon the angular position of the cam shaft 94 about the center axis thereof relative to the side plates 40 and 40'.

As shown in FIG. 5, the lever plates 100 and 100' are further formed with vertically elongated slots 104 and 104', respectively, in their respective rear end portions. As will be most clearly seen from FIG. 4, each of these slots 104 and 104' consists of a generally straight portion which is open at the lower end of the rear end portion of the lever plate and a generally semicircular upper end portion 106 merging upwardly out of the straight portion and slightly protruding rearwardly from the upper end of the straight portion. Thus, the straight portion of each of the slots 104 and 104' is defined by and between a front vertical edge 108 having one end at the open lower end of the slot and merging upwardly into the upper end of the semicircular edge forming the semicircular upper end portion 106, and a rear vertical edge 110 having one end at the open lower end of the slot and upwardly terminating at the lower end of the rearwardly protruding semicircular upper end portion 106 of the slot. The front and rear vertical edges 108 and 110 forming the straight portion of each of the slots 104 and 104' are spaced apart a predetermined distance and the semicircular upper end portion of each of the slots 104 and 104' has a diameter appreciably larger than the width of the straight portion.

On the side plates 28 and 28' of the frame structure 24 are fixedly mounted lever retaining pins 112 and 112' which are substantially in line with each other in a lateral direction of the printing apparatus and which project perpendicularly from the outer faces of the side plates 28 and 28', respectively, as will be seen from FIGS. 1 and 5. The above described lever plates 100 and 100' detachably engage these pins 112 and 112', respectively, through the slots 104 and 104' in the lever plates. Each of the pins 112 and 112' has a diameter which is slightly smaller than the above mentioned width of the straight portion of each of the slots 104 and 104' so that the pins 112 and 112' are loosely received within the slots 104 and 104', respectively. The lever plates 100 and 100' are thus slightly movable relative to the pins 112 and 112' not only upwardly or downwardly but forwardly or rearwardly in whichsoever of the straight portions and the semicircular upper end portions of the slots 104 and 104' the pins 112 and 112' may be located. If desired, the pins 112 and 112' may be replaced with a single elongated rod extending throughout the width of the frame structure 24 and project-outwardly from the side plates 28 and 28' for engagement with the lever plates 100 and 100' on the outer side of the side plates. The lever plates 100 and 100' further have handle portions 114 and 114', respectively, upstanding from the respective front ends of the lever plates. The handle portions 114 and 114' of the lever plates 110 and 110' extend upwardly through the rear slots 54 and 54', respectively, in the side ledge portions 50 and 50' of the top plate 38 of the carrier support structure 36 as will be seen from FIGS. 1 and 4. The handle portions 114 and 114' thus projecting each in part above the side ledge portions 50 and 50' of the top plate 38 of the support structure 36 are movable forwardly and rearwardly through the slots 54 and 54', respectively, in the ledge portions for permitting the operator of the printing apparatus to manually turn the lever plates 100 and 100' in either direction relative to the side plates 40 and 40' of the support structure about a horizontal axis passing through the cam slots 102 and 102' in the lever plates.

Each of the lever plates 100 and 100' is urged to turn about the above mentioned axis of rotation thereof in a direction to have its rear end portion angularly raised relative to each of the pins 112 and 112' by suitable biasing means such as a preloaded helical tension spring 116 which is shown anchored at one end to the front end of the lever plate and at the other end to a spring retaining pin 118 which is secured to each of the side plates 40 and 40' of the carrier support structure 36. The rotational movement of each of the lever plates 100 and 100' is limited by a stop element 120 which is secured to each of the side plates 40 and 40' of the support structure 36 and which is located to be engageable with the lower edge of each of the lever plates. The stop elements 120 on the side plates 40 and 40' are substantially aligned with each other in a lateral direction of the printing apparatus and are located so that, when the lever plates 100 and 100' are held in engagement at their respective lower edges with these elements, the lever plates extend horizontally in a fore-and-aft direction of the printing apparatus as will be seen from FIG. 4 in which only the lever plate 100 provided on the right-hand side of the carrier support structure 36 is shown.

When the lever plates 100 and 100' are thus held in engagement with the stop elements 120 on the side plates 40 and 40' of the carrier support structure 36, the pins 112 and 112' on the side plates 28 and 28' are located in the respective straight lower portions of the rear slots 104 and 104' in the lever plates 100 and 100', respectively. On the other hand, the carrier support structure 36 is constantly urged to tilt forwardly downwardly about its axis of rotation passing through the respective center axes of the previously mentioned pivotal pins or studs 48 on the side plates 28 and 28' of the frame structure 24 by reason of the weight of the support structure per se and the various weights borne by the support structure. By virtue of the moment of force thus exerted on the support structure 36, the lever plates 100 and 100' engaging the side plates 40 and 40' of the support structure through the eccentric cams 96 and 96' and the cam shaft 94 are also urged to turn about the above mentioned axis of rotation of the support structure 36 in a direction having their respective rear end portions angularly raised relative to the pins 112 and 112' on the side plates 28 and 28' of the frame structure 24. Since, under these conditions, the pins 112 and 112' are located within the respective straight lower portions of the rear slots 104 and 104' in the lever plates 100 and 100', respectively, as above mentioned, the lever plates are forced at the rear vertical edges 110 of the rear slots 104 and 104' against the pins 112 and 112' on the side plates 28 and 28', respectively, of the frame structure 24 with the result that the lever plates 100 and 100' and accordingly the carrier support structure 36 are constrained from being tilted down forwardly about the axis of rotation passing through the pins or studs 48. Thus, the carrier support structure 36 is maintained in a horizontal position in which the respective rear travelling portions of the type carrier band 66 and the inking ribbon 74 on the top plate 38 of the support structure 36 are located immediately in front of the print-line position on the printing sheet 16 set on the paper feed mechanism 12 as indicated by full lines in FIG. 2 and are thus capable of performing printing operation in cooperation with the printing hammers 82 within the frame structure 24.

Figure 6:
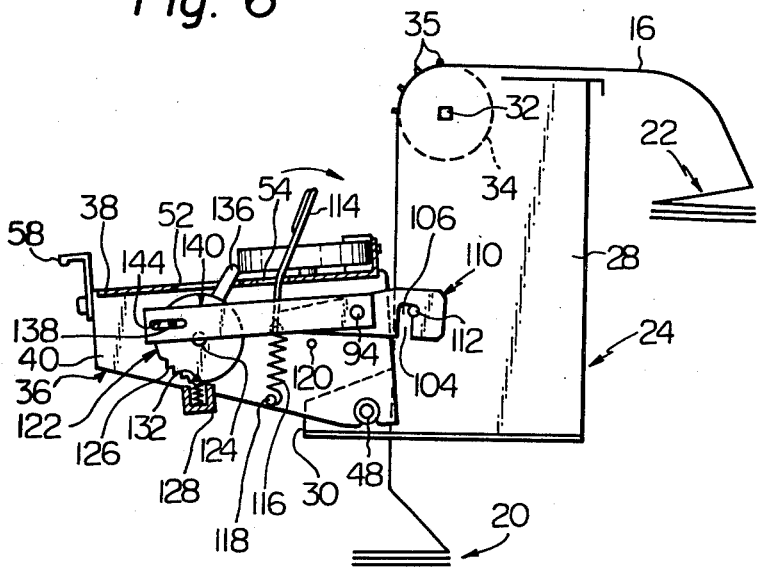
FIG. 6 is a schematic side elevational view showing a condition in which the position retaining means in the embodiment illustrated in FIGS. 1 to 5 is actuated for facilitating insertion of a printing paper into the printing apparatus.

If, under these conditions, the handle portions 114 and 114' of the lever plates 100 and 100' are manually moved rearwardly through the slots 54 and 54' in the side ledge portions 50 and 50', respectively, in the top plate 38 of the support structure 36, the lever plates 100 and 100' are caused to turn in a direction to have their respective rear end portions moved downwardly relative to both of the frame and support structures 24 and 36 with the result that the pins 112 and 112' on the side plates 28 and 28', respectively, of the frame structure 24 are disengaged from the respective rear vertical edges 110 of the slots 104 and 104' in the lever plates 100 and 100' and are enter the previously mentioned semicircular upper end portions 106 of the slots 104 and 104' in the lever plates. The lever plates 100 and 100' are now allowed to slightly move forwardly relative to the lever retaining pins 112 and 112' and accordingly to the frame structure 24 and, in turn, allow the carrier support structure 36 to turn forwardly downwardly about the axis of rotation passing through the respective center axes of the pivotal pins or studs 48 on the bracket portions 30 of the side plates 40 and 40', respectively, of the support structure 36 until the support structure 36 reaches a certain inclined position in which the cam shaft 94 providing engagement between the carrier support structure 36 and the lever plates 100 and 100' is forwardly spaced apart a maximum allowed distance from the lever retaining pins 112 and 112' which are forced against the curved rear edges of the respective semicircular upper end portions 106 of the rear slots 104 in the lever plates 100 and 100', as indicated by phantom lines in FIG. 2 or more clearly by full lines in FIG. 6 of the drawings. When the carrier support structure 36 is thus moved into the downwardly inclined position, the stop elements 120 on the side plates 40 and 40' of the support structure 36 are disengaged downwardly from the lower edges of the lever plates 100 and 100' as seen in FIG. 6 because the forces of the tension springs 116 connected to the lever plates 100 and 100' are overcome by the previously mentioned moment of force exerted on the support structure 36. With the carrier support structure 36 held in this position, the previously mentioned horizontal gap 44 between the front plate 26 of the frame structure 24 and the rear end of the top plate 38 of the support structure 36 is enlarged and provides ease for passing a printing sheet or a set of printing sheets through such a gap during mounting of the printing sheet or sheets on the paper feed mechanism 12 of the printing apparatus. The carrier support structure 36 can be moved back into the initial horizontal position thereof simply by manually raising the front end of the support structure 36 at the lifting handle 58. The lifting of the carrier support structure 36 from the downwardly inclined position thereof is aided by the tension springs 116 which, during lifting of the support structure, act to urge the support structure to turn upwardly about the axis of rotation passing through the pivotal pins or studs 48. It may be herein noted that, when the carrier support structure 36 is being thus angularly moved between the horizontal and downwardly inclined positions thereof, the angular positions of the eccentric cams 96 and 96' are maintained substantially unchanged although they will slightly vary relative to the lever plates 100 and 100' having the cams received in the cam slots 102 and 102'. In other words, the functions of the eccentric cams 96 and 96' do not lend themselves to the angular movement of the carrier support structure 36 between the above mentioned horizontal and downwardly inclined positions of the support structure.

The angular movement of the eccentric cams 96 and 96' relative to the side plates 40 and 40' of the carrier support structure 36 is effected by the previously mentioned clearance adjusting means forming further part of the apparatus according to the present invention. The clearance adjusting means is shown consisting of a stepwise acting motion translating mechanism which comprises a reversible-motion ratchet wheel 122 rotatably mounted on a shaft 124 mounted on the side plate 40 of the carrier support structure 36 and having a center axis substantially parallel with the lateral dimension of the printing apparatus as will be best seen in FIG. 5, the shaft 124 and accordingly the ratchet wheel 122 being located forwardly of the lever plate 100 on the side plate 40. The ratchet wheel 122 is formed with a suitable number of notches 126 along a portion of its circumference, the number of the notches 126 being preferably equal to the desired number of the pitches to which the previously mentioned clearance between the rear travelling portion of the type carrier band 66 and the printing hammers 82 within the frame structure 24 is to be adjusted. In conjunction with the toothed peripheral portion of the ratchet wheel 122 thus provided is positioned a ball retainer cup 128 which is fixedly mounted on the side plate 40 of the carrier support structure 36. The retainer cup 128 is formed with a bore 130 which is open toward and in the vicinity of the toothed peripheral portion of the ratchet wheel 122 and closed at the opposite end of the bore by a bottom portion of the cup as will best seen from FIG. 4. A rigid ball 132 is positioned at the open end of the bore 130 in the retainer cup 128 and is held in pressing engagement with the toothed peripheral portion of the ratchet wheel 122 by means of a helical compression spring 134 which is seated between the ball 132 and the bottom of the bore 130. The ball 132 is thus received in any one of the notches 126 in the ratchet wheel 122 depending upon the angular position of the ratchet wheel 122 relative to the side plate 40 of the support structure 36, serving as a catch element for the reversible-motion ratchet wheel 122. The ratchet wheel 122 is fixedly connected to a clearance adjusting handle 136 which projects upwardly through the previously mentioned front slot 52 formed in the right-hand side ledge portion 50 of the top plate 38 of the support structure 36 so that the ratchet wheel 122 can be manually driven to turn about the shaft 124 from above the top plate 38. As the ratchet wheel 122 is rotated on the shaft 124, the ball 132 engaging the toothed peripheral portion of the ratchet wheel 122 is moved deeper into the bore 130 in the retainer cup 128 with the compression spring 134 axially compressed each time the teeth between the notches 126 in the ratchet wheel ride on the ball successively. When the ratchet wheel 122 thus rotated about the center axis of the shaft 124 into a certain angular position having one of the notches 126 located adjacent to the ball 132, the ball is forcibly received in the particular notch by the force of the compression spring 134 and thereby maintains the ratchet wheel 122 in the particular position until the ratchet wheel is for a second time driven to turn about the shaft 124. The ratchet wheel 122 has fixedly attached thereto a guide pin 138 which projects substantially perpendicularly from the outer side face of the ratchet wheel and which is located at a suitable distance from the center axis of the shaft 124 so that the guide pin 138 is movable upwardly and downwardly in an arc about the axis of the shaft 124 when the ratchet wheel 122 is turned about the axis of the shaft 124 through an angle corresponding to the extent of the toothed peripheral portion of the ratchet wheel 122.

The clearance adjusting means further comprises an elongated rocking member 140 extending over the outer face of the side plate 40 of the carrier support structure 36 generally in a fore-and-aft direction of the support structure 36. The rocking member 140 has a rear end portion fixedly connected to the axial end portion of the previously described cam shaft 94 projecting from the eccentric cam 96 on the right-hand side plate 40 of the support structure 36 and is thus rotatable in its entirety about the center axis of the cam shaft 94 relative to the side plate 40 of the support structure 36. The rocking member 140 further has a front end portion located on the outer side of the above described ratchet wheel 122 and formed with a slot 144 which is elongated in a longitudinal direction of the rocking member 140. The guide pin 138 on the outer face of the ratchet wheel 122 is slidably received in this elongated slot 144 in the rocking member 140.

Figure 7:
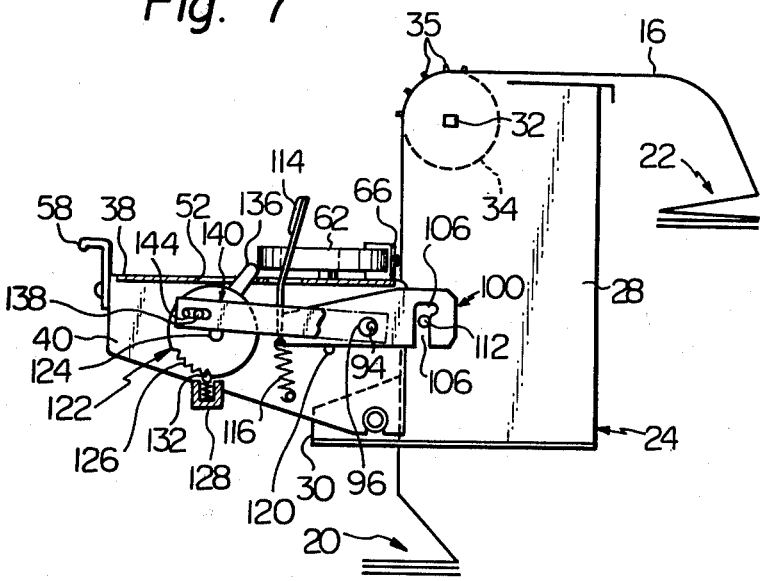
FIG. 7 is a view similar to FIG. 6 but shows a condition in which the clearance adjusting means provided in the embodiment illustrated in FIGS. 1 to 5 is in a condition producing a minimum clearance between the type carrier and the row of the printing hammers of the printing apparatus.

When, now, the ratchet wheel 122 of the clearance adjusting means thus constructed and arranged is held in an angular position in which the ball 132 serving as a click or catch element for the ratchet wheel 122 is located in the notch at one end of the toothed peripheral portion of the ratchet wheel as schematically illustrated in FIG. 7, the guide pin 138 on the outer side face of the ratchet wheel 122 assumes the highest allowed position relative to the side plate 40 of the carrier support structure 36 so that the rocking member 140 engaging the guide pin 138 through the slot 144 therein is held, with respect to the side plate 40 of the carrier support structure 36, in a clockwise extreme angular position in FIG. 7 about the center axis of the cam shaft 94. Under these conditions, the cam shaft 94 secured to the rocking member 140 assumes about the center axis thereof an angular position having the eccentric cams 96 and 96' held in angular positions having their respective high lobe portions in contact with the respective front vertical edges of the cam slots 102 and 102' in the lever plates 100 and 100', which are therefore urged to move forwardly relative to both the side plates 40 and 40' of the carrier support structure 36 and the side plates 28 and 28' of the frame structure 24. When the carrier support structure 36 is in the horizontal position thereof, the lever retaining pins 112 and 112' on the side plates 28 and 28' of the frame structure 24 are maintained in contact with the respective rear vertical edges 110 (FIG. 4) of the rear slots 104 and 104' in the lever plates 100 and 100' as previously described and are therefore constrained from being moved forwardly relative to the side plates 28 and 28' of the frame structure 24. It therefore follows that the forces exerted by the eccentric cams 96 and 96' urging the lever plates 100 and 100' to move forwardly as above described urge the side plates 40 and 40' of the carrier support structure 36 to move rearwardly relative to the lever plates 100 and 100' and accordingly to the side plates 28 and 28' of the frame structure 24. Accordingly, the carrier support structure 36 is held in such an angular position about the axis of rotation passing through the respective center axes of the pivotal pins or studs 48 that the previously mentioned clearance between the rear travelling portion of the type carrier band 66 and the printing hammers 82 (FIG. 2) is minimized as will be seen from FIG. 7. The eccentric cams 96 and 96' may be assembled to the respectively associated lever plates 100 and 100' in such a manner that the angular position of the carrier support structure 36 thus providing the minimum clearance between the type carrier band 66 and the printing hammers 82 corresponds to the above mentioned horizontal position of the support structure 36.

Figure 8:
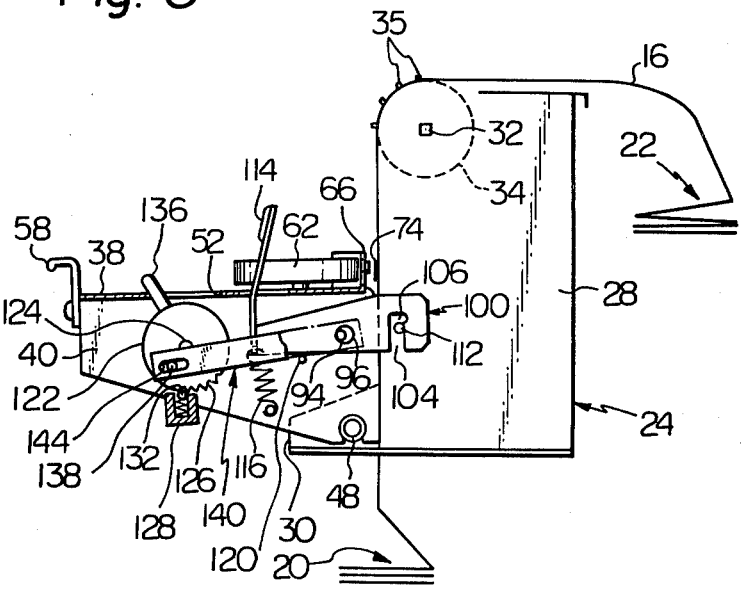
FIG. 8 is a view similar to FIG. 7 but shows a condition in which the clearance adjusting means of the printing apparatus is in a condition producing a maximum clearance between the type carrier and the row of the printing hammers.

As the ratchet wheel 122 is driven at the clearance adjusting handle 136 by the operator of the printing apparatus and is stepwise rotated away from the above described angular position thereof about the center axis of the shaft 124 with the individual notches 126 in the ratchet wheel moved successively past the ball 132, the guide pin 138 on the ratchet wheel 122 is also stepwise moved in an arc downwardly relative to the side plate 40 of the carrier support structure 36. This causes the rocking member 140 to stepwise turn away from the above mentioned clockwise extreme angular position thereof about the center axis of the cam shaft 94. As the rocking member 140 is thus stepwise rotated about the center axis of the cam shaft 94 in a direction in which the rocking member 140 is inclined downwardly relative to the side plate 40 of the carrier support structure 36, the eccentric cams 96 and 96' secured to the rocking member 140 through the cam shaft 94 are also stepwise rotated about the center axis of the shaft 94 with the result that the above mentioned high cam lobe portions of the cams 96 and 96' are brought into sliding engagement with the rear edges of the respective cam slots 102 in the lever plates 100 and 100'. The lever plates 100 and 100' are now urged to move rearwardly with respect to the side plates of the frame and support structures 24 and 36 so that the respective rear vertical edges 110 of the rear slots 104 in the lever plates 100 and 100' are slightly disengaged rearwardly from the lever retaining pins 112 and 112', respectively, on the side plates 28 and 28' of the frame structure 24. The carrier support structure 36 which is constantly subjected to the previously mentioned moment of force is therefore allowed to tilt downwardly about the axis of rotation passing through the respective center axes of the pivotal pins or studs 48 until the rear vertical edges 110 of the slots 104 and 104' in the lever plates 100 and 100' are for a second time brought into abutting engagement with the lever retaining pins 112 and 112', respectively, on the side plates 28 and 28' of the frame structure 24. When the carrier support structure 36 is thus tilted downwardly, there is provided an enlarged clearance between the rear travelling portion of the type carrier band 66 and the printing hammers 82 (FIG. 2) located at the rear of the particular portion of the band 66. Such a clearance becomes maximum when the ratchet wheel 122 is turned about the center axis of the shaft 124 into a counterclockwise extreme angular position having the ball 132 received in the notch at the other end of the toothed peripheral portion of the ratchet wheel 122 and the guide pin 138 located in the lowest allowed position relative to the side plate 40 of the carrier support structure 36 as will be seen from FIG. 8. If desired, the eccentric cams 96 and 96' may be assembled to their respectively associated lever plates 100 and 100' in such a manner that the previously mentioned horizontal position of the carrier support structure 36 is achieved when the ratchet wheel 122 assumes an angular position in which the ball 132 is received in the notch at the middle of the toothed peripheral portion of the ratchet wheel 122 as illustrated in FIG. 4.

While it has been assumed that the eccentric cams 96 and 96' and the associated lever plates 100 and 100' are provided on both sides of the printing apparatus, only one set of eccentric cam and associated lever plate may be provided on either side of the printing apparatus. Where, however, the carrier support structure 36 is constructed of relatively thin plates or any members having a relatively low torsional rigidity so that a difficulty may be encountered in maintaining constant the clearance between the type carrier band 66 and the printing hammers throughout the effective width of the clearance, it is preferable that two sets of cams and associated lever plates be used as in the embodiment hereinbefore described.

Figure 9:
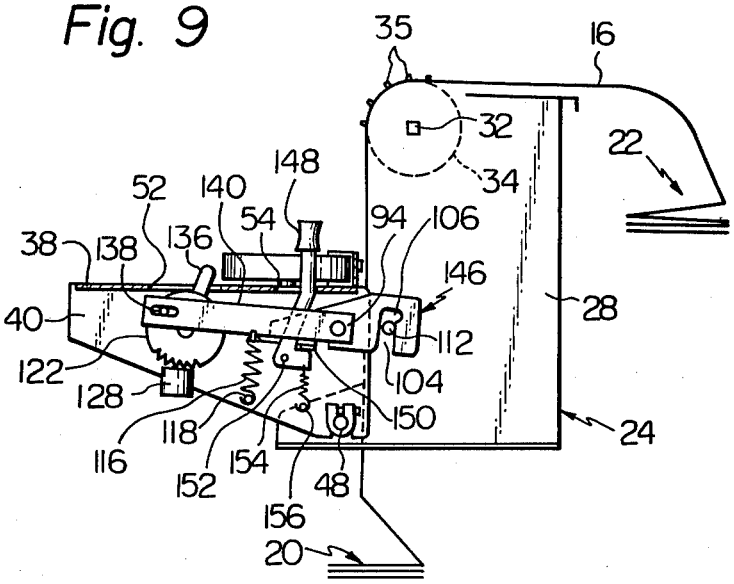
FIG. 9 is a schematic side elevational view showing another preferred embodiment of the printing apparatus according to the present invention.

FIG. 9 illustrates another preferred embodiment of the printing apparatus according to the present invention. In the embodiment herein shown, the position retaining means comprises a lever plate 146 and a manipulating handle 148 which is constructed separately of the lever plate 146. The lever plate 146 is constructed and arranged similarly to the lever plate 100 in the embodiment of FIGS. 1 to 8 except in that the handle 148 is constructed as an independent member as above mentioned and that the lever plate 146 has a laterally outwardly bent projection 150 at the lower end of the plate. The handle 148 is configured in the form of a bellcrank lever having an intermediate fulcrum portion pivoted at 152 on the side plate 40 of the carrier support structure 36, and a rearwardly directed lower arm portion engageable at its upper edge with the above mentioned projection 150 of the lever plate 146. The handle 148 has a main arm portion upstanding from the intermediate fulcrum portion of the handle and extends upwardly through the rear slot 54 in the right-hand side ledge portion 50 (see FIG. 1) of the top plate 38 of the carrier support structure 36. The handle 148 thus constructed and arranged is urged to have its main arm portion moved rearwardly and its lower arm portion moved downwardly, viz., away from the lateral projection 150 of the lever plate 146 by suitable biasing means such as a preloaded helical tension spring 154 which is anchored at one end to the lower arm portion of the handle 148 and at the other end to a spring retainer pin 156 secured to the side plate 40 of the carrier support structure 36. When the handle 148 is pulled forwardly through the slot 54 in the top plate 38 of the carrier support 36, the lower arm portion of the handle is angularly raised about the axis of the pin 152 against the force of the tension spring 154 with the result that the lever plate 146 is caused to turn about a horizontal axis coincident with or slightly offset from the center axis of the cam shaft 94 in a direction in which the rear end portion of the lever plate is moved downwardly relative to the side plate 28 of the frame structure 24. As has been described in respect of the embodiment shown in FIGS. 1 to 8, the angular movement of the lever plate 146 in this direction causes the carrier support structure 36 to tilt forwardly downwardly from the previously mentioned horizontal position thereof about the axis of rotation passing through the respective center axes of the pivotal pins or studs 48. While, thus, the handle portion 114 integral with the lever plate 100 provided in the embodiment of FIGS. 1 to 8 must be turned in the opposite direction to the direction in which the carrier support structure 36 is to be tilted forwardly downwardly, the handle 148 provided in the embodiment shown in FIG. 9 can be turned in the same direction as the direction in which the carrier support structure 36 is to be moved away from the horizontal position thereof. Furthermore, the carrier support structure 36 in the embodiment of FIG. 9 can be moved back into the horizontal position thereof simply by moving the handle 148 rearwardly through the slot 54 in the top plate 38 of the support structure 36 and thereby causing the lever plate 146 to turn in the reverse direction. The means such as the lifting handle 58 provided in the embodiment of FIGS. 1 to 8 for assisting the operator of the printing apparatus in raising the carrier support structure 36 from the inclined position thereof can be dispensed with in the embodiment of FIG. 9.

What is claimed is:

1. A printing apparatus having lateral and fore-and-aft dimensions and including a stationary structure, a plurality of printing hammers arranged in a row within said stationary structure in a direction substantially parallel with the lateral dimension of the apparatus, a tiltable structure positioned in front of said stationary structure and rotatable about an axis of rotation which is substantially parallel with said lateral dimension and which is fixed with respect to said stationary structure, and a type carrier movable on said tiltable structure and having a substantially straight travelling path located in front of said row of printing hammers and substantially parallel with said lateral dimension, wherein the improvement comprises position retaining means constantly engaging both said stationary structure and said tiltable structure and operable for retaining said tiltable structure in an operative position having said travelling path of said type carrier located adjacent to said row of printing hammers for forming an elongated clearance between and in parallel with said travelling path and said row of printing hammers and an inoperative position downwardly inclined about said axis of rotation away from said stationary structure, cam means engaging said stationary structure through said position retaining means and rotatable relative to said tiltable structure about an axis of rotation which is fixed with respect to said tiltable structure and which is substantially parallel with said axis of rotation of said tiltable structure, said position retaining means rotatable about an axis substantially parallel and movable with respect to said axis of rotation of said cam means between a first angular position engaging said stationary structure through one portion of said position retaining means and holding said tiltable structure in said operative position thereof and a second angular position engaging said stationary structure through another portion of said position retaining means and allowing said tiltable structure to move into said inoperative position thereof, and clearance adjusting means mounted on said tiltable structure and securely connected to said cam means for rotation about said axis of rotation of said cam means, said clearance adjusting means being manually operated for driving said cam means to produce rotation thereof, the engagement between said cam means and said position retaining means being such that when said cam means is turned about its said axis of rotation said cam means is operative to urge said position retaining means to move relative to said tiltable structure in a direction substantially parallel with said fore-and-aft dimension when said position retaining means is in said first angular position.

2. The improvement as set forth in claim 1, in which said lever retaining element extends substantially parallel with said lateral dimension of said printing apparatus and said lever is formed with a slot having said lever retaining element located therewithin, said slot having a first portion receiving said lever retaining element therewithin when said lever is in said first angular position thereof and a second portion receiving said lever retaining element therewithin when said lever is in said second angular position thereof.

3. The improvement as set forth in claim 2, in which said lever has a substantially straight, vertical edge portion at the rear end of said first portion of said slot and a curved edge portion defining the rear end of said second portion of said slot and protruding rearwardly with respect to said first portion of the slot, said vertical edge portion being in engagement with said lever retaining element for thereby limiting the forward movement of the lever when the lever retaining element is located within said first portion of the slot, said curved edge portion being engagement with said lever retaining element for thereby limiting the forward movement of the lever when said lever retaining element is located within said second portion of the slot.

4. The improvement as set forth in claim 3, in which said lever is formed with a cam slot having a predetermined measurement in a direction perpendicular to said lateral dimension and in which said cam means comprises an eccentric cam rotatable about said axis of rotation of said cam means and received in said cam slot, said cam having a diameter substantially equal to said predetermined measurement of said cam slot.

5. The improvement as set forth in claim 3 or 4, in which said clearance adjusting means further comprises biasing means urging said lever to turn about said axis of rotation of said position retaining means in a direction to have said lever retaining element located within said first portion of said slot.

6. The improvement as set forth in claim 5, in which said position retaining means further comprises a stop element fast on said tiltable structure and engageable with said lever for limiting the angular movement of the lever in said direction to have said lever element located within said first portion of said slot.

7. The improvement as set forth in claim 3 or 4, in which said clearance adjusting means comprises a motion-translating mechanism having a manually-operated rotatable member having an axis of rotation substantially parallel with said lateral dimension and fixed with respect to the tiltable structure, and a rocking member engaging said rotatable member and securely connected to said cam means, said rocking member being movable with the rotation of said rotatable member for driving said cam means for rotation about said axis of rotation of the cam means.

8. The improvement as set forth in claim 7, in which said rotatable member has a guide element fast on the rotatable member and extending substantially in parallel with said lateral dimension and in which said rocking member is formed with a slot receiving said guide element therewithin.

9. The improvement as set forth in claim 8, in which said rotatable member has a curved portion formed with a plurality of notches and in which said clearance adjusting means further comprises a spherical catch element engaging said curved portion of said rotatable member for being received in any one of said notches depending upon the angular position of the rotatable member about said axis of rotation of the rotatable member, and biasing means urging said catch element against said curved portion of said rotatable member.

10. The improvement as set forth in claim 2, in which said position retaining means further comprises a manually-operated manipulating member engageable with said lever and rotatable about an axis of rotation substantially parallel with said lateral dimension and fixed with respect to said tiltable structure, said manipulating member being in driving engagement with said lever for turning the lever to turn about said axis of rotation of said position retaining means in a direction to have said lever retaining element located within said second portion of said slot when the manipulating member is driven to turn downwardly away from said stationary structure.

11. The improvement as set forth in claim 10, in which said position retaining means further comprises biasing means urging said manipulating member to disengage from said lever.

12. The improvement as set forth in claim 1, in which said position retaining means comprises a lever retaining element fastened on said stationary structure, and a lever constantly engaging said cam means and rotatable with respect to said lever retaining element about said axis of rotation of said position retaining means between said first and second angular positions respectively corresponding to said first and second angular positions of said position retaining means.

* * * * *